United States Patent [19]

Monetti

[11] Patent Number: 4,787,527

[45] Date of Patent: Nov. 29, 1988

[54] PLASTICS CONTAINER

[75] Inventor: Giovanni Monetti, Racconigi, Italy

[73] Assignee: Monetti S.p.A., Racconigi, Italy

[21] Appl. No.: 113,979

[22] Filed: Oct. 29, 1987

[30] Foreign Application Priority Data

Oct. 31, 1986 [IT] Italy ..... 54030/86[U]

[51] Int. Cl.[4] ..... B65D 8/00

[52] U.S. Cl. ..... 220/74; 220/355; 229/2.5 R

[58] Field of Search ..... 220/74, 352, 353, 354, 220/355; 229/2.5

[56] References Cited

U.S. PATENT DOCUMENTS

| | | | |
|---|---|---|---|
| 1,926,240 | 9/1933 | Maas | 220/355 |
| 3,107,027 | 10/1963 | Hong | 229/2.5 X |
| 3,229,886 | 1/1966 | Grogel | 220/72 X |

*Primary Examiner*—Steven M. Pollard

*Attorney, Agent, or Firm*—Sughrue, Mion, Zinn, Macpeak, and Seas

[57] ABSTRACT

A plastics container, particularly for use in general catering, comprises a body (1) in the form of a parallelepipedal bowl with rounded corners and provided with a peripheral flange having a downwardly-inclined part (5). The body (1) is closed by a shallow tray-shaped cover (2) which enters the cavity of the body and has a peripheral flange (8*a*, 8*b*, 8*c*) which rests on the inner edge of the inclined part (5) of the flange of the body (1) so as to keep the peripheral edges of the flanges of the body and the cover spaced from each other to facilitate opening of the container. The flange of the body (1) has a peripheral edge (6) which is bent vertically downwardly and, in correspondence with the corners of the flange, is bevelled in its lower part (6*a*) to form a gripping tab (7) in its upper part for lifting of the container.

5 Claims, 2 Drawing Sheets

FIG. 1
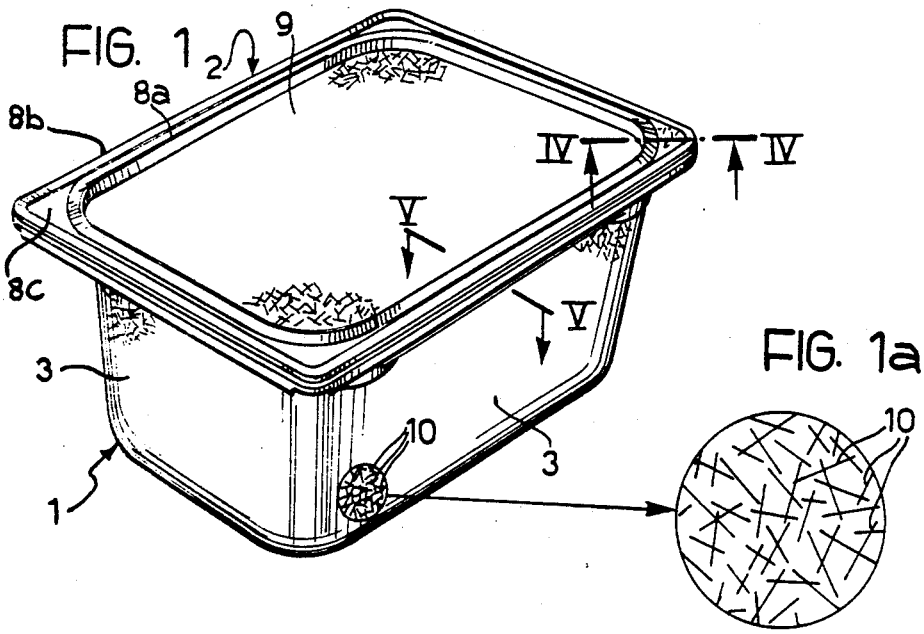
FIG. 1a
FIG. 2
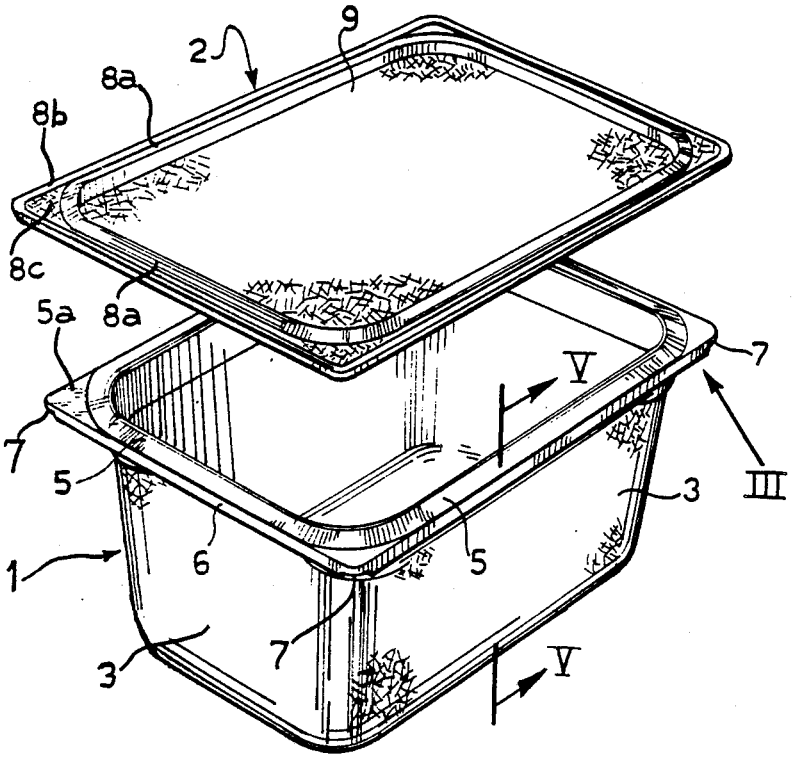

PLASTICS CONTAINER

The present invention relates to plastics containers of the type described in the preamble to claim 1.

Containers of this type are widely used, particularly for containing food products in general catering.

The principal object of the present invention is to produce a container which is more hygienic than known containers and in which it is possible to remove the cover from the container without the cover being provided with a gripping member.

This object is achieved by the characteristic which is the subject of claim 1.

Further characteristics and advantages of the present invention will become clear from the description which follows with reference to the appended drawings, provided purely by way of non-limiting example, in which:

FIG. 1 is a perspective view of the container,

FIG. 1*a* is a detail FIG. 1 on an enlarged scale,

FIG. 2 is an exploded view of the container,

Figure 3:
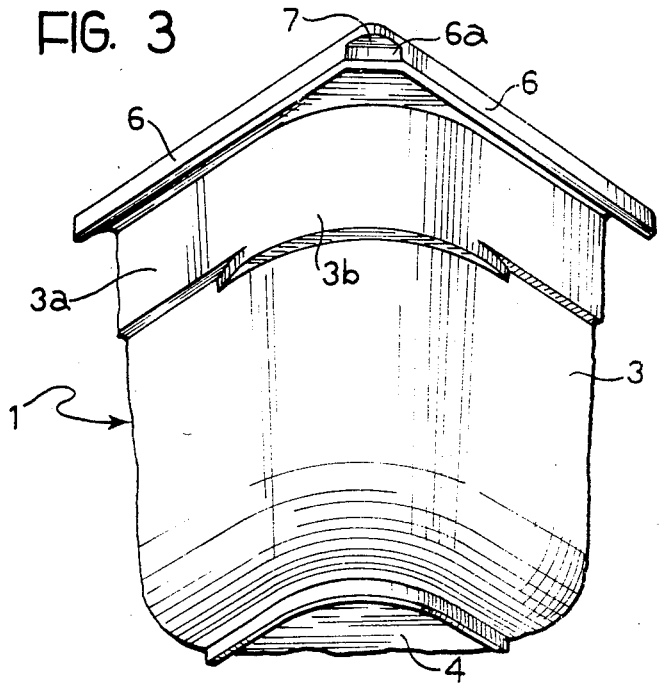
FIG. 3 is a perspective view of the body of the container from below.

The container illustrated in the drawings comprises a body 1 which is in the form of a substantially parallelepipedal bowl with rounded corners, and is closed at the top by a cover 2.

The body 1 is provided with four lateral walls 3 connected to each other by curved surfaces and with a flat bottom 4.

The walls 3 are inclined to the vertical by an angle A of the order of 5° and have an upper zone 3*a* projecting outwardly to form a step which constitutes a support surface for stacking a plurality of containers.

At its rounded corners, the projecting zone 3*a* has a part 3*b* which extends downwardly to limit the support between stacked containers to the corner zones.

The edge of the body 1 is provided with an outer flange of rectangular outline; this flange has a part 5 which is inclined to the horizontal by an angle B of the order of 15°.

The flange has a peripheral edge 6 bent vertically downwardly and, at each of the corner zones, the flange has a substantially triangular flat zone 5*a* between the inclined part 5 and the bent edge 6.

At the vertex of each of the triangular zones 5*a*, the bent edge 6 of the flange 5 has a bevel 6*a* at approximately 45° in its central lower part so as to provide a gripping tab 7 in its central upper part.

Figure 4:
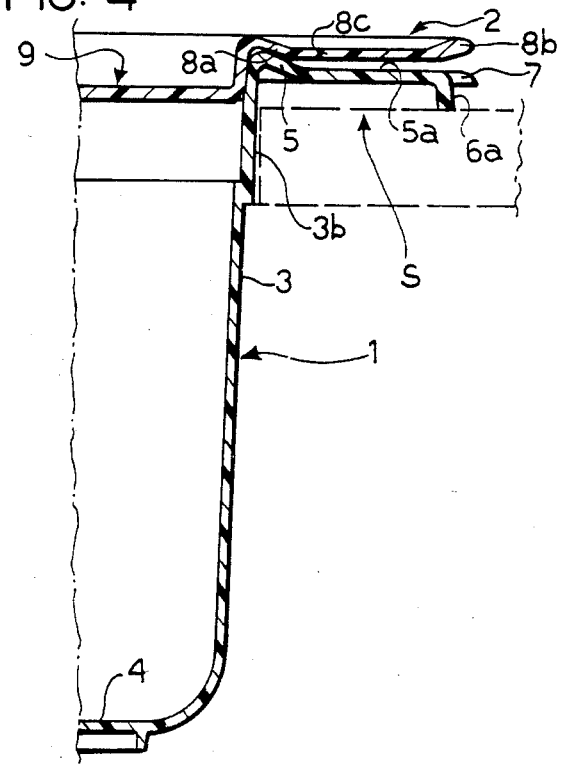
FIG. 4 is a section taken on the line IV—IV of FIG. 1 on an enlarged scale.
Figure 5:
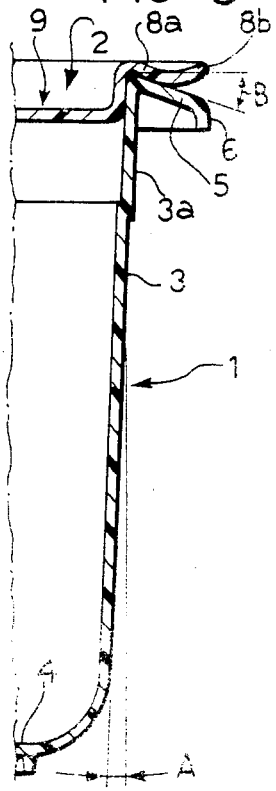
FIG. 5 is a section taken on the line V—V of FIG. 1 on an enlarged scale.

The gripping tab 7 serves for the lifting of the body 1 when the container rests, by means of the edge 6 of its flange 5, on the edge of a support surface S (illustrated with broken lines in FIG. 4) provided with an aperture in which the container is accommodated, as occurs when the container is used to contain foods for general catering.

In this use, the inclined part 5 of the flange serves to make any liquids which may fall on the flange drain outwardly.

The cover 2 has a shallow tray-shaped part 9 having a rectangular outline with rounded corners and intended to enter the container 1, and a peripheral flange having a rectangular outline similar to that of the flange of the body 1. The flange of the cover 2 has a downwardly-inclined inner part 8*a* intended to rest on the more inclined part 5 of the flange of the body 1, and an upwardly-bent peripheral part 8*b*. In each of the corner zones, the flange of the cover 2 has a substantially triangular flat zone 8*c* between the parts 8*a* and 8*b*.

Due to the different inclinations and the different lengths of the parts 5 and 8, the flange of the cover 2 rests only on the inner edge of the part 5 of the flange of the body 1, so that a space remains between the flat parts 8*c*, 5*a* of the two flanges which facilitates removal of the cover. In fact, the exertion of a pressure near the vertex of one of the flat zones 8*c* of the flange of the cover 2 causes a small upward rotation of the cover 2 relative to the body 1, so as to enable the cover to be gripped at the opposite side.

The body 1 and the cover 2 are preferably produced in transparent material and are provided on their outer surfaces with a slightly raised pattern 10 in the form of intersecting segments in various orientations.

This pattern does not reduce the transparency of the container but prevents any surface scratching of the container, which may occur during use, from becoming visible, enabling the original appearance of the container to be maintained with time.

I claim:

1. A plastics container comprising a body in the form of a substantially parallelepipedal bowl having substantially vertical walls with rounded corners and provided with a peripheral flange of rectangular outline around its edge, and a cover having a shallow tray-shaped part having substantially vertical walls with rounded corners complementary to the walls of said bowl which engage the walls of the bowl and a peripheral flange which rests on the flange of the body and has a rectangular outline corresponding to that of the flange of the body, wherein the flange of the body has a part which is inclined downwardly at a sharp angle relative to the walls of said bowl wherein the flange of the cover has a first section which is inclined downwardly at a sharp angle relative to the walls of said tray shaped part and engages the inclined part of the flange of the body about the entire periphery, wherein the rectangular flange of the body and the rectangular flange of the cover have a flat zone at each of their corners, and in that the flat zones are spaced from each other when the cover is fitted onto the body, so as to enable partial lifting of the cover due to a pressure exerted on one of the flat zones of the cover.

2. A container according to claim 1, wherein the flange of the body has a peripheral edge which is bent vertically downwardly, and in that, at each corner of the flange, the bent edge has a bevel at approximately 45° in its lower part so as to provide in its upper part a tab usable as a gripping member for lifting the container.

3. A container according to claim 1, wherein the inclined part of the flange of the body is inclined by approximately 15° to the horizontal.

4. A container according to claim 1, wherein the lateral walls of the body are inclined at approximately 5° to the vertical.

5. A container according to claim 1, made of transparent plastics material and provided on its outer surface with a slightly raised pattern in the form of intersecting segments in various orientations.

* * * * *